United States Patent [19]

Haberer

[11] 4,002,508

[45] Jan. 11, 1977

[54] COMPOSITION FOR PERMANENT MAGNETS OF THE FAMILY "RARE EARTHS-TRANSITION METALS" AND PROCESS FOR PRODUCING SUCH A MAGNET

[75] Inventor: Jean-Paul Haberer, Saint Martin d'Heres, France

[73] Assignee: Aimants Ugimag S.A., France

[22] Filed: Aug. 14, 1975

[21] Appl. No.: 604,747

[30] Foreign Application Priority Data

Aug. 27, 1974 France ..... 74.29345

[52] U.S. Cl. ..... 148/31.57; 75/152; 75/200; 75/224; 148/101; 148/103; 148/105

[51] Int. Cl.[2] ..... H01F 1/04

[58] Field of Search ..... 148/31.57, 101, 103, 148/105; 75/152, 200, 211, 224

[56] References Cited

UNITED STATES PATENTS

| | | | |
|---|---|---|---|
| 3,546,030 | 12/1970 | Buschow et al. | 148/31.57 |
| 3,844,851 | 10/1974 | Haberer | 148/103 |
| 3,873,379 | 3/1975 | Yamakawa et al. | 148/103 |

OTHER PUBLICATIONS

Narasimhan, R; et al.; *Magnetic Properties of* $RT_{x-1}Ni_x$, in *J. Appl. Phys.*, 44, Feb. 1973, pp. 879–882.

Nassau, K; et al.; *Intermetallic Compounds . . . Lanthanons and Transition Metals*, in *J. Phys. Chem. Soc.*, 16, 1960, pp. 123–130.

*Primary Examiner*—Walter R. Satterfield

*Attorney, Agent, or Firm*—William Anthony Drucker

[57] ABSTRACT

The present invention relates to a composition for permanent magnets of the family "rare earths-transition metals" wherein in a structure of the $SmCo_5$ type, 2 to 15% of the cobalt atoms are replaced by nickel.

This can be applied to the production by the sintered powder technique of permanent magnets having a particularly high intrinsic coercivity.

6 Claims, 1 Drawing Figure

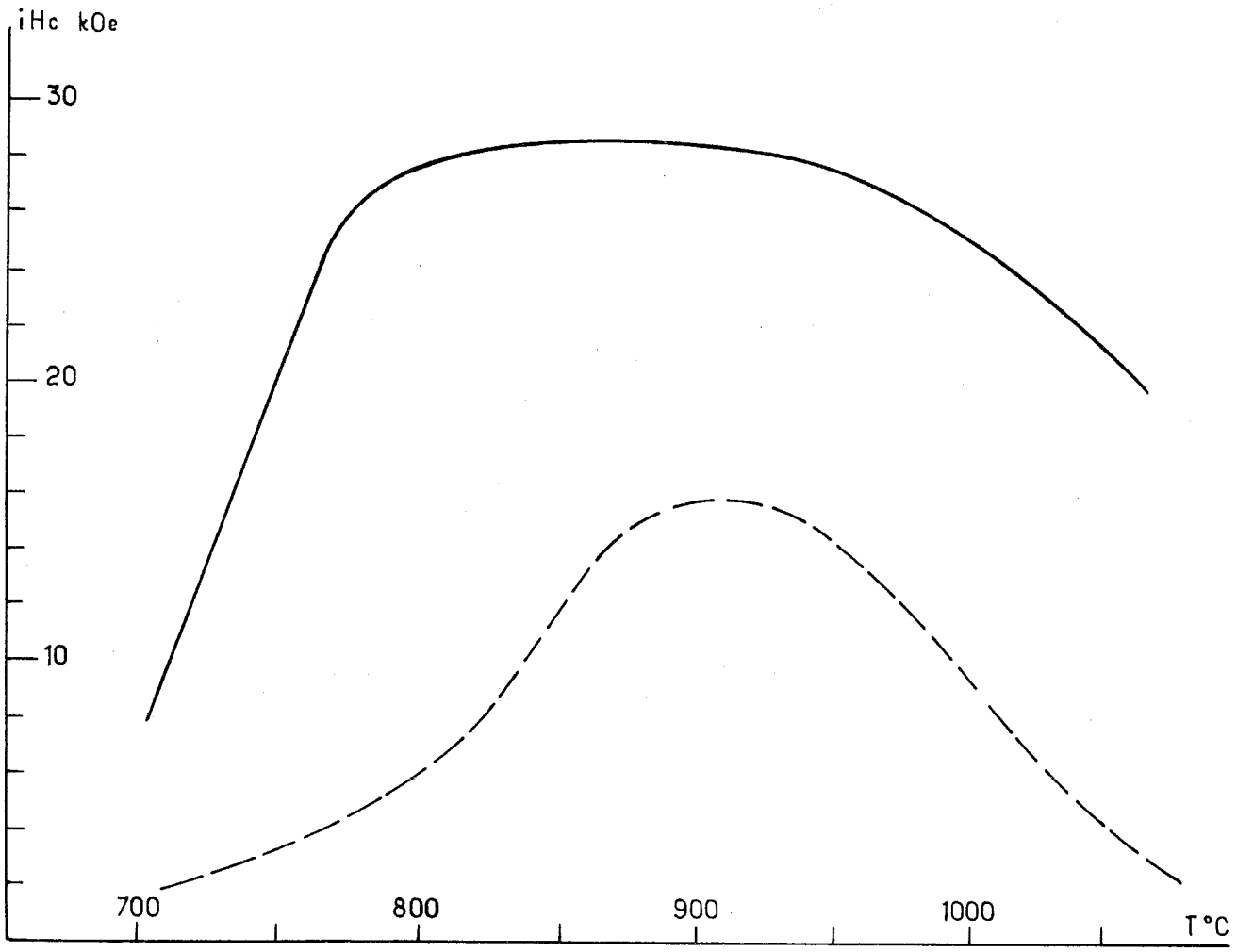
iHc kOe
30
20
10
700
800
900
1000
T °C

COMPOSITION FOR PERMANENT MAGNETS OF THE FAMILY "RARE EARTHS-TRANSITION METALS" AND PROCESS FOR PRODUCING SUCH A MAGNET

The present invention relates to the production of permanent magnets of the family "rare earths - transition metals" and more particularly to those obtained by the sintered powder technique and in which cobalt is the main transition metal, whilst samarium is the main rare earth.

It is known that materials based on the alloys cobalt and samarium, of the $SmCo_5$ or $Sm_2Co_{17}$, structure have a high saturation magnetisation and a high crystalline anistrophy making them particularly suitable for the production of permanent magnets.

Such magnets have been prepared by the metallurgical casting method in which fine particles are created in in situ by adding a transition metal differing from cobalt e.g. copper, to the basic structure and which the coercivity of the material only appears as a result of an appropriate heat treatment intended to give rise to a dispersion of ferromagnetic particles, e.g. of the $SmCo_5$ structure, in a non-ferromagnetic substrate e.g. of the $SmCu_5$ structure. However, solid magnets obtained by this method are very brittle.

A more advantageous technique which leads to a completely different internal structure of the material is that of sintered powders which substantially comprises preparing by an alloying operation followed by grinding, the powder having the requisite composition, compressing this powder with a view to forming a solid member and sintering the pellet in an inert atmosphere. This method has encountered considerable difficulties due to the structural instability of crystallographic lattices based on cobalt, because this metal aids the formation of faults which are harmful to the coercivity and the high volatility and oxidisability of the rare earth. These difficulties have only been partly obviated by on the one hand introducing an excess of rare earth, and on the other by annealing after sintering. However, the results of such treatments have unfortunately been very sensitive to slight variations in their performance temperature.

The literature has already referred to the theoretical possibility of replacing all or part of the cobalt in magnetic material of the above family by different metals, including nickel. However, no information was given on the nickel content in the alloy, on the production process used in the case of such a substitution and on the results obtained, whilst as far as is known to the Applicants this theoretical information has not found a practical application.

However, the Applicants have found that in the production of magnets with a basic $SmCo_5$ structure by the sintered powder technique the introduction of a small quantity of nickel in place of cobalt makes the thermal treatment conditions less critical without impairing the magnetic properties of the product obtained and the latter has in fact an increased hysteresis coercivity (hence a better resistance to demagnetisation). It is stressed that this is a surprising effect because a considerable deterioration of the magnetic properties was to be expected through a drop in the Curie temperature, the saturation magnetisation and the crystalline anisotropy.

According to the invention a permanent magnet of the family described hereinbefore, produced by the sintered powder technique and in which the transition metal is mainly cobalt and the rare earth mainly samarium, has a rare earth content between 35 and 42% by weight and has a nickel content between 0.5 and 15% by weight and preferably 1.8 to 7% by weight.

When the nickel content in the composition exceeds 7 to 9% by weight there is no sudden deterioration of the magnetic properties of the product but the decreased saturation magnetisation makes the material a little less interesting.

The invention also has for its object a process for producing magnets from the above-defined composition, characterised by a degassing operation by continuous pumping performed in the sintering chamber, during the first phase of the increase in the sintering temperature prior to the actual sintering, which is then performed in per se known manner in an inert gas atmosphere.

Preferably this continuous pumping operation is performed at between the ambient temperature and a temperature of about 900° C.

The degassing operation makes it possible to reduce the residual $Sm_2O_3$ oxide content which is formed during sintering, thereby improving the properties of the magnetic material obtained.

The invention will be better understood from the following examples given in a non-limitative manner. In the appended drawing, a graph shows the effect of the annealing temperature on the coercivity of the material.

EXAMPLE 1

In an alumina crucible heated by means of an induction furnace, an alloy is prepared having the following weight composition:

| | |
|---|---|
| Sm | 36.7 % |
| Co | 57 % |
| Ni | 6.3 % |

Advantageously this alloy is prepared according to the method described in U.S. Pat. No. 3,816,189 filed on Dec. 10, 1971 by Societe d'Etudes et de Recherches Magnetiques, for "Process and device for the manufacture of alloys of transition elements and metals of the rare-earth group intended for the production of permanent magnet materials." This prior patent is incorporated to the present disclosure by way of reference.

This method substantially comprises firstly introducing cobalt into the crucible and then carrying out its fusion, followed by cooling to 1,100° C and slowly diffusing the samarium in the solid state, and it reduces the samarium lost by evaporation and prevents the destruction of the crucible.

The alloy obtained is then reduced to powder until it has a Fisher size of about 3 microns. In the press and in the presence of an orientation magnetic field, cylindrical pellets are formed having a density close to 65% of the theoretical density. Advantageously, these pellets are completely coated in a protective powder formed by an auxiliary alloy of samarium e.g. $Sm_2Co_{17}$. This is obtained as follows: the pellets are placed in iron containers in which they are completely buried in a powder of the auxiliary alloy. This technique has the advantage of continuing oxygen elimination (auxiliary alloy acting as a getter) during sintering and producing a samarium vapour pressure which locally opposes evaporation of samarium in the pellet.

The thus coated pellets are introduced into a sintering machine which is connected to a vacuum pump. The temperature rise to 900° C takes, for example, 15 minutes, whilst maintaining a vacuum. After 10 minutes at 900° C whilst maintaining the vacuum, a rare gas e.g. helium, is introduced, pumping is stopped and the temperature is raised to 1,130° C. A temperature of 1,130° C is maintained for about 1 hour after which the sintering tube is allowed to cool naturally in the open air until ambient temperature is reached. After recoating the pellets in the above-mentioned auxiliary alloy, they are returned to the furnace under an inert gas for performing in per se known manner, annealing for about ten hours at about 900° C. The tube is suddenly removed from the furnace and tempered in water accompanied by agitation to bring it to ambient temperature.

The final product has the following properties:

| | | | |
|---|---|---|---|
| Residual intrinsic induction | Br | = | 7,400 gauss |
| Intrinsic coercive field | | = | 31,000 oersteds |
| Density | | | 8,3 |

To clearly show the advantages of the invention under the same operating conditions a product starting from the following weight conditions was prepared:

| | |
|---|---|
| Sm | 36.7 % |
| Co | 63.3 % |

The product of example 1 is therefore derived from the latter by substituting nickel for cobalt relative to about 10% of the cobalt atom. The following values are obtained:

Br = 8650 iHc = 15300

It can thus be seen that the substitution of nickel for cobalt leads to an enormous increase in the intrinsic coercivity without any significant decrease in the residual induction.

On measuring the properties of the pellets after sintering but before annealing, the following values are obtained:

| | |
|---|---|
| For the composition with nickel: | Br = 7400<br>iHc = 19800 |
| For the conventional composition without nickel: | Br = 8650<br>iHc = 4200 |

Even without annealing the composition with nickel leads to a higher coercivity than that obtained without nickel and with annealing.

For the conventional composition without nickel and on varying the annealing temperature between 700° and 1050° C, an important variation in the intrinsic coercivity iHc is obtained (expressed in kilo oersteds), as shown by the dotted line curve in the graph. On dropping below a value of about 900° C, demixing of the $SmCo_5$ structure occurs which is unstable, above 900° C, thermal agitation causes numerous structural defects. As the correct annealing temperature is a function of the composition this leads to considerable difficulties in producing the product.

The solid line curve, corresponding to the alloy of example 1, shows that the introduction of nickel eliminates the critical nature of the annealing temperature, which represents a significant advantage.

To illustrate the significance of the degassing operation as performed in the above example, the performance of the process was modified in the following manner and the following results were obtained:

With pumping at ambient temperature and the introduction of the inert gas, before the rise in the sintering temperature, the following results are obtained for the composition with nickel of example 1:

Br = 6800 iHc = 15000

Density of final product: 7.8

These results show that the sintering is incorrect. Despite the presence of an inert atmosphere during sintering, there is oxidation of the samarium. In actual fact in the case of press-densified pellets the air occluded in the pores causes, on the one hand, the formation of a samarium oxide coating around the particles which opposes densification, and on the other, the deterioration of the samarium alloy, resulting in composition displacements or defects harmful to the coercivity. Coating by an auxilliary alloy does not entirely solve these problems.

Pumping maintained during the temperature rise to about 900° C, with or without stages at 900° C, facilitates the removal of air occluded in the pores and ensures a better control of the final composition, densification and magnetic properties.

A precise choice of the temperature (of the order of 900° C) up to which pumping is maintained depends on the size of the pellet, the more or less volatile and oxidisable nature of the rare earth, and the excess of rare earth relative to the theoretical stoichiometry.

If pumping is maintained throughout the thermal sintering cycle, samarium evaporates and the following values are obtained:

| | | |
|---|---|---|
| Density: 8.3 | Br = 7200 | iHc = 20000 |

These results are clearly inferior to those of the process of example 1.

EXAMPLE 2

The procedure is as in example 1 but the following composition is used:

Sm = 36.7 %

Co = 61.4 %

Ni = 1.9%

The end product has the following properties:

Br = 8100 iHc = 29200

EXAMPLE 3

The procedure is an in example 1 but the following composition is used:

Sm = 36.7 %

Co = 59.5 %

Ni = 3.8 %

The end product has the following properties:

Br = 7700 iHc = 31000

Obviously the compositions can be varied without passing beyond the scope of the invention. The samarium content is advantageously in the range 35 to 42% by weight of the total composition and the nickel content between 0.5 and 15% by weight and preferably between 1.8 and 7% by weight.

The sintering temperature and period are in accordance with the limits of the prior art. The annealing temperature can, as shown in the graph, vary within wide limits (800° to 1000° C for example), whilst remaining below the sintering temperature.

The samarium can be partly replaced by another rare earth and the rare earth mixture known under the name "Misch metal" can particularly be used.

What is claimed is:

1. A permanent magnet having a residual intrinsic induction of at least 7,400 Gauss and an intrinsic coercive field of at least 29,200 Oersteds and having as the active magnetic component a degassed and sintered product of compacted particulate material, said material containing an amount of 35 to 42 % by weight of samarium, an amount of 64.5 to 43 % by weight of cobalt and an amount of 0.5 to 15 % by weight of nickel.

2. A permanent magnet having a residual intrinsic induction of at least 7,400 Gauss and an intrinsic coercive field of at least 29,200 Oersteds, and having as the active magnetic component a degassed and sintered product of compacted particulate material, said material containing an amount of 35 to 42 % by weight of a mixture of samarium and misch metal, an amount of 64.5 to 43 % by weight of cobalt and an amount of 0.5 to 15 % by weight of nickel.

3. A permanent magnet according to claim 1, wherein the nickel content is between 1.8 and 7 % by weight.

4. A permanent magnet according to claim 1, wherein the samarium content is 36.5 % by weight.

5. In a method of producing a permanent magnet, comprising the steps of (a) preparing an alloy containing an amount of 35 to 42 % by weight of samarium, an amount of 64.5 to 43 % by weight of cobalt and an amount of 0.5 to 15 % by weight of nickel, of (b) reducing the said alloy to powder form, of (c) compressing the resulting powder to form a pellet, of (e) sintering the pellet in an inert gas atmosphere, of (f) annealing, and (g) tempering the sintered pellet at a temperature and for a time selected to yield a residual intrinsic induction of at least 7,400 Gauss and an intrinsic coercive field of at least 29,200 Oersteds, the additional step (d), carried out intermediate the steps (c) and (e) of raising the temperature of the pellet between ambient temperature and about 900° C, while performing a degassing operation through pumping.

6. A method according to claim 5, wherein the annealing step (f) is carried out at a temperature between 800° and 1,000° C.

* * * * *